US005868973A

United States Patent [19]

Müller et al.

[11] Patent Number: 5,868,973

[45] Date of Patent: Feb. 9, 1999

[54] PROCESS AND APPARATUS FOR PRODUCING FIBRETS FROM CELLULOSE DERIVATIVES

[75] Inventors: Heinz-Joachim Müller; Rudiger Leibnitz, both of Bad Kreuznach; Udo Holzki, Wörrstadt, all of Germany

[73] Assignee: Seitz-Filter-Werke FMBH, Germany

[21] Appl. No.: 831,703

[22] Filed: Apr. 10, 1997

[30] Foreign Application Priority Data

Apr. 23, 1996 [DE] Germany ..... 196 16 010.3

[51] Int. Cl.[6] ..... B29C 9/10

[52] U.S. Cl. ..... 264/8; 264/11; 264/14; 425/6; 425/7; 425/10

[58] Field of Search ..... 264/8, 11, 14; 425/6, 7, 10

[56] References Cited

U.S. PATENT DOCUMENTS

| | | | |
|---|---|---|---|
| 3,342,921 | 9/1967 | Brundige et al. . | |
| 3,441,473 | 4/1969 | Brundige et al. . | |
| 3,785,918 | 1/1974 | Kawai et al. . | |
| 3,842,007 | 10/1974 | Caputi et al. . | |
| 3,961,007 | 6/1976 | Caputi, Jr. et al. | 264/140 |
| 4,040,856 | 8/1977 | Litzinger | 264/13 |
| 4,047,862 | 9/1977 | Keith | 425/8 |
| 4,192,838 | 3/1980 | Keith et al. | 264/10 |
| 4,219,512 | 8/1980 | Sinn et al. | 264/14 |
| 4,224,259 | 9/1980 | Sander et al. | 264/11 |
| 4,237,081 | 12/1980 | Murphy et al. | 264/9 |
| 5,071,599 | 12/1991 | McNair, Jr. et al. | 254/5 |
| 5,175,276 | 12/1992 | McNair, Jr. et al. | 536/58 |

*Primary Examiner*—Mary Lynn Theisen
*Attorney, Agent, or Firm*—Nixon & Vanderhye P.C.

[57] ABSTRACT

The disclosure is a more economical process for producing fibrets of superior quality by directing a dope comprising a cellulose derivative and a suitable solvent therefor into a coagulant and exposing it there to a shearing field to coagulate of the dope and form the fibrets. The fibrets, the solvent and the coagulant are then separated off. The suspension formed from the dope and the coagulant is alternately accelerated and decelerated in the shearing field at least once, preferably at least twice. This makes it possible to maintain a high average degree of turbulence over a long distance, so that a dope of high viscosity can be processed. In the apparatus for producing fibrets, the at least one nozzle (46–49) is disposed within a dispersing facility (40) comprising rotor (44) and stator (43, 45) and further comprising at least two sprockets (50–53), of which at least one sprocket (50) is part of the rotor (44) of the dispersing facility (40).

29 Claims, 5 Drawing Sheets

PROCESS AND APPARATUS FOR PRODUCING FIBRETS FROM CELLULOSE DERIVATIVES

DESCRIPTION

Figure 1:
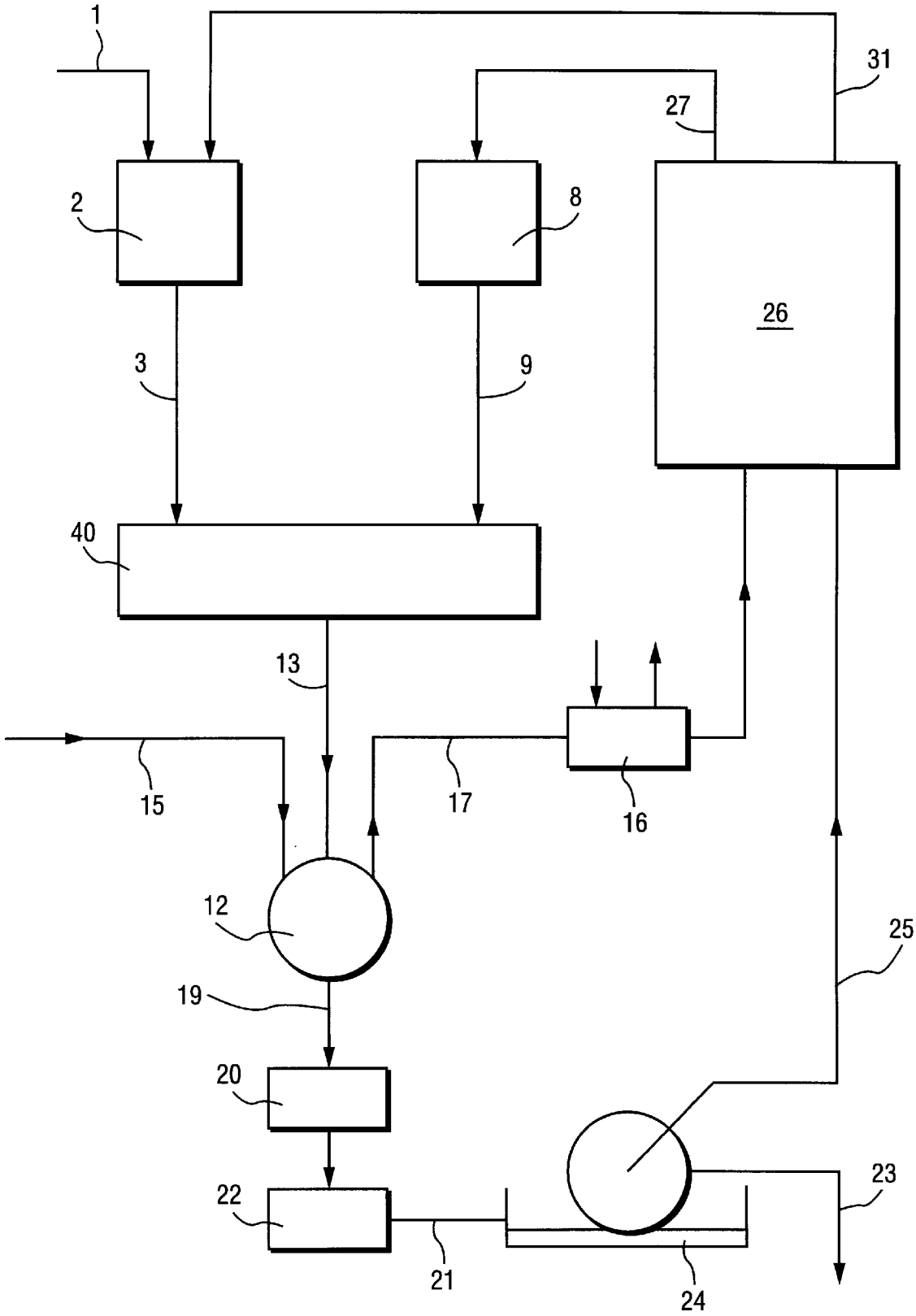

This invention relates to processes and apparatus for producing fibrets.

Fibrets for the purposes of this invention are very fine fibers having very fine fiber diameters and thus a very high specific surface area (surface area per unit mass). Fibrets are typically produced by means of a coagulation process or by extrusion, although an extrusion process usually involves a coagulation as a subsidiary process. Owing to their method of production, some of the fibrets are obtained in the form of a fiber assembly or network. The diameters of the individual fibers are generally below 5 $\mu$m, usually below 1 $\mu$m. The dimensions of the fiber networks, which are also known as agglomerates and which can be varied within wide limits through the conditions of the production process and through further workup steps, range up to 1 mm. However, agglomerate sizes of below 200 $\mu$m are desired. The dimensions mentioned provide specific surface areas of above 20 $m^2/g$.

The fibrets are chiefly contemplated for use in depth filters for liquid filtration, and these filters are also utilized for testing the quality of the fibrets produced. For depth filters to work optimally, it is crucial to achieve low pore sizes coupled with a high porosity. This ensures filtration with high separation rates at low pressure differentials. In addition, the embedding of the fibrets in fiber networks has the advantage over particulate material and shortened staple fibers that the fibers are very firmly tied into the filter and thus the possibility of fibers being shed during the filtration can be very substantially ruled out. The fiber structure in the agglomerate assembly provides the filters with high strength coupled with flexibility, which is of advantage for pleating.

The use of fibrets is not restricted to depth filters for liquid filtration. In webs for air filtration, for example, fibrets can take the place of glass fibers whose harmful effect on ingress into the lung is known. Since the very large surface area would produce a very white color in most polymers, fibrets can be used as optical brighteners in the paper industry. Small amounts of residual solvent can cause the fibers to fuse together during drying, so that, for example in nonwovens, the strength can be significantly increased. The large specific surface area which is very substantially accessible to a percolating medium makes fibrets advantageously useful for adsorption processes, including chromatographic processes. This effect can be augmented by the incorporation of surface-active substances or by a chemical modification of the starting material prior to fibret production or in the subsequent production process.

Fibrets can in principle be produced from a multiplicity of materials. The limits are merely dictated by the solvent and the viscosity of the solution. Owing to their advantages in the choice of solvent, the fibrets hitherto described in the literature have chiefly been fibrets composed of cellulose esters, especially cellulose acetate, having specific surface areas of above 20 $m^2/g$. For application in depth filters for liquid filtration, fibrets composed of cellulose acetate also have the advantage that substantial homogeneity of material is obtained together with the cellulose pulp used in any case as matrix material. This makes for trouble-free disposal. Compared with the kieselguhrs, perlites and/or metal oxides preferred at present, furthermore, the advantages of the very low ion release and of the complete biodegradability are to be emphasized.

The production of fibrets composed of cellulose esters using solvents is known in principle, for example from U.S. Pat. No. 3,342,921, U.S. Pat. No. 3,441,473, U.S. Pat. No. 3,785,918, U.S. Pat. No. 3,842,007, U.S. Pat. No. 3,961,007, U.S. Pat. No. 4,040,856, U.S. Pat. No. 4,047,862, U.S. Pat. No. 4,192,838, U.S. Pat. No. 5,071,599 and U.S. Pat. No. 5,175,276. It is customary to prepare a solution (dope) of a cellulose ester and a suitable solvent for the cellulose ester. A cellulose ester nonsolvent which is completely miscible with the solvent can be present in such proportions as to not significantly affect the solubility of the cellulose ester in the solvent. This solution is coagulated, usually under the action of shearing forces, in a cellulose ester nonsolvent or coagulant which is completely miscible with the solvent.

The coagulation process is carried out using single-material nozzle systems, stirred systems, two-material nozzle systems and T-pipe systems.

In single-material nozzle systems, described for example in U.S. Pat. No. 3,441,473 and U.S. Pat. No. 4,040,856, the dope is spray-dispensed above the coagulation bath, so that an at least partial spontaneous evaporation of the solvent commences. The shearing effect required to produce fibrets is obtained in the process of the spontaneous change of state at the nozzle outlet, such as volume expansion, solvent evaporation and temperature drop. However, it has been found that this process variant cannot provide the required fiber fineness and homo-geneity. The fiber diameters are predominantly above 1 $\mu$m.

Stirred systems as described in U.S. Pat. No. 4,047,862 comprise a rotating disk with radial extrusion orifices through which the dope is directed into the coagulation bath via a stationary circumferential wall located at a distance from the disk. The dope exits from the nozzles at a certain velocity and only experiences deceleration thereafter. Such systems have the disadvantage that it is difficult to establish a defined shearing field. On the one hand, the shearing gap has to be small to ensure an intensive shearing field. On the other, smaller distances harbor the risk of blocking the extrusion nozzles, which can only be prevented by greater flow velocity of the coagulant perpendicularly to the shearing field. Larger distances, in turn, result in a shearing gradient which is too low. Furthermore, the resulting fibrets dampen the turbulence to a high degree, since the extrusion orifice—wall distance of 1.6 mm is only insignificantly larger than the maximum agglomerate size of 1 mm, so that post-coagulation solids contents above 1% by mass (=weight) cannot therefore be exceeded. Since the turbulences are increasingly dependent on the solids content, the stirred arrangement has poor partial-load characteristics. Furthermore, the extrusion velocity of the dope is affected by centrifugal forees, since the extrusion nozzles are disposed in the rotating disk. The coagulation conditions are likewise impaired as a result.

Two-material nozzle systems as described in U.S. Pat. No. 4,192,838, U.S. Pat. No. 5,071,599 and U.S. Pat. No. 5,175,276 and also the T-pipe systems, described in U.S. Pat. No. 3,961,007, for example, utilize a similar principle. Dope and coagulation medium flow cocurrently in two-material nozzles, but counter-currently in T-pipe systems during coagulation. In two-material nozzles, the nozzle diameter—usually>2.5 mm—has to be so large to avoid coagulation of the solution at the nozzle orifice. The nozzle diameter is accordingly 20,000 times the size of the required fiber diameter. Even a turbulent flow of the coagulation medium in the constriction of the valve nozzle creates turbulence and concentration gradients which, as well as fine fibers, result in the creation of larger fibers. This is all the more likely the higher the post-coagulation solids contents. Solids contents above 1% by mass cannot be exceeded if the required fiber fineness is to be ensured.

The countercurrent process of the T-pipe systems is the more effective variant as regards vortex formation and hence the formation of the shearing field. However, the flux of the coagulation bath is very strongly decelerated in the process, so that the coagulation conditions vary greatly. As well as giving rise to the formation of very fine fibers which meet the aforementioned requirements, it is impossible to avoid the production of coarser fibers, especially in the case of post-coagulation solids contents of about 1% by mass. These dimensions can only be insignificantly affected by post-coagulation workup steps, in contradistinction to the agglomerate size. The partial-load and blockage characteristics of the countercurrent variant must likewise be considered undesirable.

The disadvantage of the known production process is that large amounts of solvent have to be recirculated. For instance, 8 kg of solvent, for example acetone, are required for the production of 1 kg of fibrets in U.S. Pat. No. 5,071,599 and U.S. Pat. No. 5,175,276. In U.S. Pat. No. 3,842,007 and U.S. Pat. No. 3,961,007, for example, 1 kg of fibrets requires, respectively, between 20 and 80 kg or 33 kg of solvent, such as acetone, 1,4-dioxane or methyl acetate.

Since the fibrets have to be available for most applications in a solvent-free or low-solvent state, an operation is needed to remove the solvent from the fibrets. The initial choice for this would be a filtration in which a solution of solvent and nonsolvent for the cellulose ester is separated from the fibrets. Owing to the very large surface area of the fibrets, the filter cake obtained is very porous and has a low solids content. Customarily, a maximum solids content of about 12% by mass is achieved for fibrets having a specific surface area >20 $m^2/g$ under a filtration pressure difference of up to 1 bar. Under pressures of above 1 bar or in a centrifugal force field, the solids content is up to 20% by mass. The solvent quantity remaining in the fibrets is for most applications too high for further processing. In addition, the solvent in the solution means that the fibret surface is not fully hardened. The employment of pressure will destroy the network structure to some extent, which leads to clumping at high pressures. This is why a filtration is usually carried out under the action of shearing forces, producing solids contents of at most 4% by mass for fibrets having specific surface areas of above 20 $m^2/g$. In the most favorable case of 8 kg of solvent for 1 kg of fibrets, the post-filtration fibrets-to-solvent ratio is about 1:1; the solvent predominates in other cases.

For the reasons mentioned, the filtration would have to be followed by a possibly multistage washing process as described for example in U.S. Pat. No. 3,961,007. However, in the course of these processes the concentration of solvent in the filtrate becomes very low. But a low concentration of solvent and the large amounts of solution to be processed make the solution workup costs rise exponentially. A workup is necessary because the solvent should be recycled into the fibret formation process for environmental reasons and to make the overall process economical. Otherwise, the costs for the at least eight-fold solvent quantity would have to be all included in the fibret price and, what is more, disposal costs would be incurred. High volumes of solution to be worked up for a low concentration of solvent to be recovered likewise make the workup/recovery costs rise steeply. The fibret production process is therefore in both cases economically uninteresting for most applications.

In addition, filtration alone is usually not sufficient to remove the solvent from the fibrets. The as-coagulated fibret material still includes solvent which has passed into the liquid by diffusion and can be removed from there. This is why distillation is frequently employed to remove acetone. The costs for this distillation are highly dependent on the concentration of the solvents and on the volume of the fibret suspension. The two quantities are also reflected in the volume of distillate and in the concentration of solvent in the distillate, affecting the costs for working up the distillate. These costs in turn are critical for economical application of the fibrets in consequential products.

It is an object of the present invention to provide a process and apparatus for more economical production of the fibrets in better quality.

This invention is based on the insight that a workup of the coagulation bath constituents separated from the fibrets is sensible and economical only when the coagulant used for the coagulation bath may have a very high proportion of solvent and when it is ensured at the same time that the removed solvent portion which is reused for making up the dope may still have a nonsolvent portion. The greater the permitted post-workup "impurity" of the individual components, the lower the effort required. The contamination of the solvent by the nonsolvent, and vice versa, reaches its limit when the dope made up with the recovered solvent is nu longer processible. An excessively high proportion of nonsolvent can lead to premature coagulation, on the one hand, and to an excessively high dope viscosity, on the other.

It was found that the coagulation can be carried out in a conventional dispersing facility according to the rotor/stator principle. Such dispersing facilities are marketed for example by Ystral under the designation of "Dispergiermaschine" and by IKA Maschinenbau under the name of "Dispax-Reaktor". These dispersers customarily comprise two to six shearing sprockets, which are preferably configured alternately as stators and rotors. The rotors reach speeds of up to 12,000 revolutions per minute, so that, in the coagulation bath, basic flow velocities of up to, preferably, 100 m/sec can be achieved. These known dispersing facilities with their high peripheral velocities are customarily used for emulsifying, suspending, homogenizing and dissolving dispersions. Although the use of batchwise dispersing systems is possible within the framework of the subject invention, the advantages of continuous dispersing systems reside in the consistent assurance of a uniform quality of product.

Since the suspension formed from dope and coagulant is alternately accelerated and decelerated in the shearing field at least once, preferably at least twice, a high average degree of turbulence is maintained over a long distance, so that a high viscosity dope can be processed. The suspension is preferably subjected alternately to a radial and a transverse flow. The dope is preferably directed into the coagulant through stationary nozzles which exit onto flow-generating means moving past.

As the suspension passes through a plurality of acceleration and deceleration fields, the dope emerging from the nozzles is seized and pulled off very rapidly, so that nozzle blockage cannot occur even at comparatively high viscosities. Furthermore, the fibrets are quickly substantially homogenized by the alternating regime of acceleration and deceleration, so that, in certain circumstances, a downstream homogenizing treatment can be dispensed with. This is evidently attributable to the fact that a high average turbulence can be maintained over a long distance, during the entire residence time in the dispersing facility, which is customarily between 0.03 and 0.5 sec. The turbulences themselves are only minimally dampened by the fibrets which form, since the turbulences are generated by rotating mechanical parts and not by a medium in turbulent flow. This has the further advantage that the partial-load characteristics of the entire arrangement are very good. Consequently, fibret quality is over wide ranges independent of the total throughput of coagulation bath and of dope and of their mutual ratio.

The dope is preferably made up using cellulose esters or cellulose ethers. Preference is given to cellulose acetate, cellulose triacetate, cellulose acetate butyrate, cellulose acetate propionate, benzylcellulose or ethylcellulose and other suitable cellulose derivatives or mixtures thereof. Preference is given to a cellulose acetate having an acetyl value between 54 and 56%. The proportion of cellulose derivatives in the dope is preferably 3–20% by mass. Lower concentrations are usually commercially unattractive, while higher proportions produce an excessively high viscosity. The proportion of cellulose derivative in the dope also determines the proportion of solvent. Suitable solvents are acetone, acetic acid, methyl acetate, methyl ethyl ketone, 1,4-dioxane, acetaldehyde, ethyl acetate, tetrahydrofuran, methyl isopropyl ketone and mixtures thereof. Acetone is particularly preferred.

Since the recovery from the coagulation bath of completely pure solvent for re-use in making up the dope is only possible at great expense, it is economically desirable for the solvent still to comprise a proportion of the nonsolvent which is the main constituent of the coagulation bath.

Preferred nonsolvents for the cellulose ester are water, ethanol and methanol, and their proportion in the dope can be up to 40% by mass.

The maximum nonsolvent content in terms of the ratio of solvent to cellulose derivative depends on the coagulation point. The higher the nonsolvent content of the dope, the faster the point of coagulation is reached. The maximum nonsolvent content is determined by the coagulation point, which depends on the temperature, inter alia. Preference is given to a nonsolvent content of 2–20% by mass below the concentration of nonsolvent at the particular coagulation point. In contradistinction thereto, U.S. Pat. No. 5,071,599 and U.S. Pat. No. 5,175,276, which describe two-material nozzle systems, permit only up to 20% by mass of nonsolvent in the dope, so that this proportion is between 8.5% and 21% below the coagulation point in the case of the cellulose acetate/acetone/water system.

Irrespectively of the composition of the dope in the vicinity of the coagulation point, the ratio of solvent to cellulose derivative is to be minimized as well. According to the state of the art as represented by U.S. Pat. No. 4,192,838, U.S. Pat. No. 5,071,599 and U.S. Pat. No. 5,175,276, the minimum ratio is 4.4. Lower ratios usually make the dope too viscous, which, in existing processes, has an adverse effect on the fibret fineness. If, for example, cellulose acetate is dissolved in acetone in a mass ratio of 1:3, a gellike consistency is obtained. However, the viscosity can be reduced by adding water as nonsolvent. In this respect, it is desirable to add water up to just below the coagulation point. However, this behavior can only be observed at high levels of cellulose derivative in the dope and/or at low solvent:cellulose derivative ratios. At low levels of cellulose ester in the dope, as is the case in U.S. Pat. No. 4,192,838, U.S. Pat. No. 5,071,599 and U.S. Pat. No. 5,175,276, for example, water usually has a viscosity-increasing effect on account of the low viscosity of acetone.

Prior art processes are not capable of producing fibrets at an acetone:water mass ratio of 2.8, for example, and a nonsolvent content up to 2% by mass below the coagulation point in the dope. The viscosity is still too high under these conditions, despite the addition of water. Owing to the very high turbulence in the process of this invention, its essential advantage is that higher dope viscosities can be processed with satisfactory results.

Since more viscous dopes can be processed, it is possible to achieve solvent:cellulose derivative ratios between 4.4:1 and 2.8:1 without deterioration in fibret quality. Particularly good results were obtained when acetone was used as solvent, cellulose acetate as cellulose ester and water as nonsolvent. A reduction in the acetone:cellulose acetate ratio from 4.4:1 to 2.8:1 means that 36% by mass less solvent has to be used to produce a given amount of fibrets, which lowers fibret production costs appreciably.

The temperature of the dope is largely uncritical for the process. Good results were obtained at room temperature. To reduce the viscosity of the solution it is possible to use a higher temperature, through to a coagulation under superatmospheric pressure and temperatures above 100° C. However, the ambient temperature is preferred as the most economical variant.

The two or three ingredients for the dope are mixed in a suitable manner to form a homogeneous solution. This solution is then supplied to the dispersing facility, if necessary via a filter.

The volume flow of coagulant in the coagulation bath is preferably adjusted so that the fibret content of the coagulation bath is between 0.1 and 2.5% by mass. No differences in fibret quality were found even at a high fibret content. It is true that coagulation is still achieved at concentrations between 2.5 and 3.5% by mass without blockage of the extrusion nozzles, but there are deficiencies in fibret fineness and fibret homogeneity. For economic reasons, a range of 1–2.5% by mass is preferred. This makes the process of this invention distinctly better than the processes of the prior art, wherein coagulation is only possible at concentrations between 0.1 and 1% by mass. This change is significant because a coagulation at 2.5% by mass gives rise to only 40% of the suspension quantity of a coagulation at 1% by mass. This means, inter alia, that the equipment can be made 60% smaller, which yields corresponding savings in capital investment costs. In the further course of the process, 60% less water/acetone solution has to be separated from the fibrets and worked up, which in turn results in energy cost savings. Furthermore, a post-coagulation filtration process prior to complete solvent removal can preferably be dispensed with. This has the advantage of not damaging the morphology of the fibrets in the filtration prior to complete solvent removal because the structure of the fibrets is not completely set as a consequence of the solvent still present.

Prior art processes have to utilize a high excess of the coagulation medium relative to the dope, especially at comparatively high viscosities of the dope, to generate adequate turbulence. In the two-material nozzle systems of U.S. Pat. No. 4,192,838 and U.S. Pat. No. 5,071,599 and also U.S. Pat. No. 5,175,276, a minimum coagulation bath:dope ratio of 11:1 is achieved. The process of this invention makes it possible to produce fibrets at coagulation bath:dope ratios of 10:1 down to 2.5:1. This has the following advantages: The concentration of the cellulose derivative in the dope can be made low. This can be a sensible and preferred way of achieving lower viscosities if fibrets are to be produced from systems other than cellulose acetate/acetone/water. If the dope comprises 5% by mass of the cellulose ester, the suspension obtained after a coagulation at a coagulation bath:dope mass ratio of 2.5:1 would have a fibrets content of 1.43% by mass. The advantages of high fibret concentrations are thus also exploitable at potentially high dope viscosities. Furthermore, fluctuations in the volume flows of coagulation bath and/or dope have over wide ranges no effect on fibret quality, and the partial-load characteristics are excellent. The reason for these advantages resides in the substantial breaking of the link between volume flow and turbulence.

Finally, it is a further advantage of the process that higher solvent concentrations may be present in the coagulation bath than in the prior art. According to U.S. Pat. No. 5,071,599, the acetone content of the coagulation bath in the acetone/cellulose acetate/water system must not be more than 15% by mass. Above this value, the acetone present in the suspension has the effect of prolonging the time the fibers take to solidify. The incompletely solidified surfaces of the fibrets can stick together and form clumps without porous fibret structure. In the process of this invention, however, the shearing effect is sufficiently powerful to separate such clumps until the fibers have completely solidified. The longer fibret solidification time, moreover, contributes to a finer fibrillation and hence to a higher surface area, since shearing forces which intensify the fibrillation are active throughout the entire solidification time. In the cellulose acetate/water/acetone system, for example, acetone contents of up to 25% by mass are possible in the coagulation bath.

Higher concentrations of solvent in the dope are favorable with regard to the rest of the workup. The higher the solvent content in the suspension, by which is meant the post-coagulation bath, the higher the solvent content will also be in the distillate (removed solvent plus residual nonsolvent), so that correspondingly fewer workup stages are necessary for the distillate. This does not give rise to disadvantages in respect of explosion control, since in virtually all variants the lower explosion limit of 2.5% by volume of acetone is exceeded in the interests of an economical construction of the process.

In the apparatus for producing the fibrets, the at least one nozzle through which the dope is directed into the coagulant is disposed within a dispersing facility which comprises rotor and stator and which comprises at least two sprockets, of which at least one sprocket is part of the rotor of the dispersing facility, and the dispersing facility comprises a feed line for the coagulant.

Coagulation bath and dope are combined in the dispersing facility to achieve coagulation. To this end, the coagulation bath flows through the dispersing machine in the well known manner of such a machine being employed for homogenizing and dispersing duties. The feed line for the coagulant preferably encloses the supply line for the dope.

The nozzle is preferably disposed in the interior of the dispersing facility and oriented to point radially outward onto the innermost sprocket. In a preferred embodiment, the first sprocket in the flow direction of the coagulation bath is part of the rotor, followed by a sprocket of a stator, etc. The sprocket—nozzle distance is made small in order that the actual coagulation may take place in that zone of the shearing field which is generated by the teeth moving past the nozzle orifice. The distance can be between 0.01 and 5 mm, with 0.01–0.1 mm being preferred. It is also possible to equip the first sprocket in the flow direction of the coagulation bath with nozzles for adding the dope.

The nozzle diameter can be chosen within wide limits, since this parameter has only little influence on fibret quality within the contemplated range. A nozzle diameter between 5 and 10 mm is preferred. However, smaller nozzle diameters are possible. Since no nozzle blockages occur in use of the dispersing facility, there is no need to use larger nozzles, although this is possible from the viewpoint of fibret quality. Low ratios of the volume streams of coagulant to dope, or a high total volume stream, make or makes it sensible to split the dope stream between a plurality of nozzles. These nozzles are preferably disposed symmetrically within the innermost sprocket. If, for example, three nozzles are provided, they are disposed in a star shape. The feed line to the nozzles is in this case preferably located at the center of the dispersing facility. To ensure identical conditions with regard to the coagulation bath flow at all the nozzles, the coagulant is also introduced centrally into the dispersing facility. This is ensured when the feed line for the coagulant preferably encloses the feed line for the dope.

It is generally assumed that fibrets form very rapidly after the dope has been introduced into the coagulation bath. The formation time is on the order of 0.001–0.5 sec. Thereafter the fibret morphology should be fixed. However, it is suspected that fibrets form by first forming an outer shell, since the concentration of nonsolvent required for coagulation is obtained first in the outer regions of the concentration clusters in the shearing field. It is through this shell that the solvent has to diffuse outward and/or the nonsolvent inward. Thus, a further time period elapses before the core is completely hard, and this time period is greater than the stated coagulation time. Since the outer morphology will have already been formed in this time period, the fibers—notwithstanding the soft inner core—have such a turbulence-inhibiting effect in the prior art process that subdivision of the fibers is no longer possible. By using a dispersing facility it is possible, through the high shearing effect exerted by the rotors, to subdivide fibers having a soft inner core and hence to increase the fineness of the fibrets.

The dispersing facility of this invention also has a positive effect in respect of the agglomerate size of the fibrets. Although, depending on the choice of the rotor-stator geometries and of the rotor speed, it is likewise possible to obtain agglomerate sizes up to 1 mm, preference is given to those arrangements and speeds which result in agglomerate sizes below 200 $\mu$m. These dimensions are achieved as a result of the fact that, unlike the prior art arrangements, the end region of the shearing field still provides sufficient shearing forces capable of minimizing the dimensions of the fibret agglomerates.

The apparatus of this invention further has the following advantages:

- It generates higher shearing forces, since higher differences in the basic flow velocities are accommodated within a confined space. This results in finer fibrillation of the fibrets and makes it possible to process higher dope viscosities.
- The shearing space available is larger than in the prior art, and the basic flow velocities are repeatedly increased and decreased within it. This likewise results in finer fibrillation of the fibrets, better partial-load characteristics and greater freedom in the choice of process parameters.
- The shearing space is governed by the principle of forced conveyance, so that there is no possibility of subsidiary streams escaping into zones of low turbulence.

Figure 2:
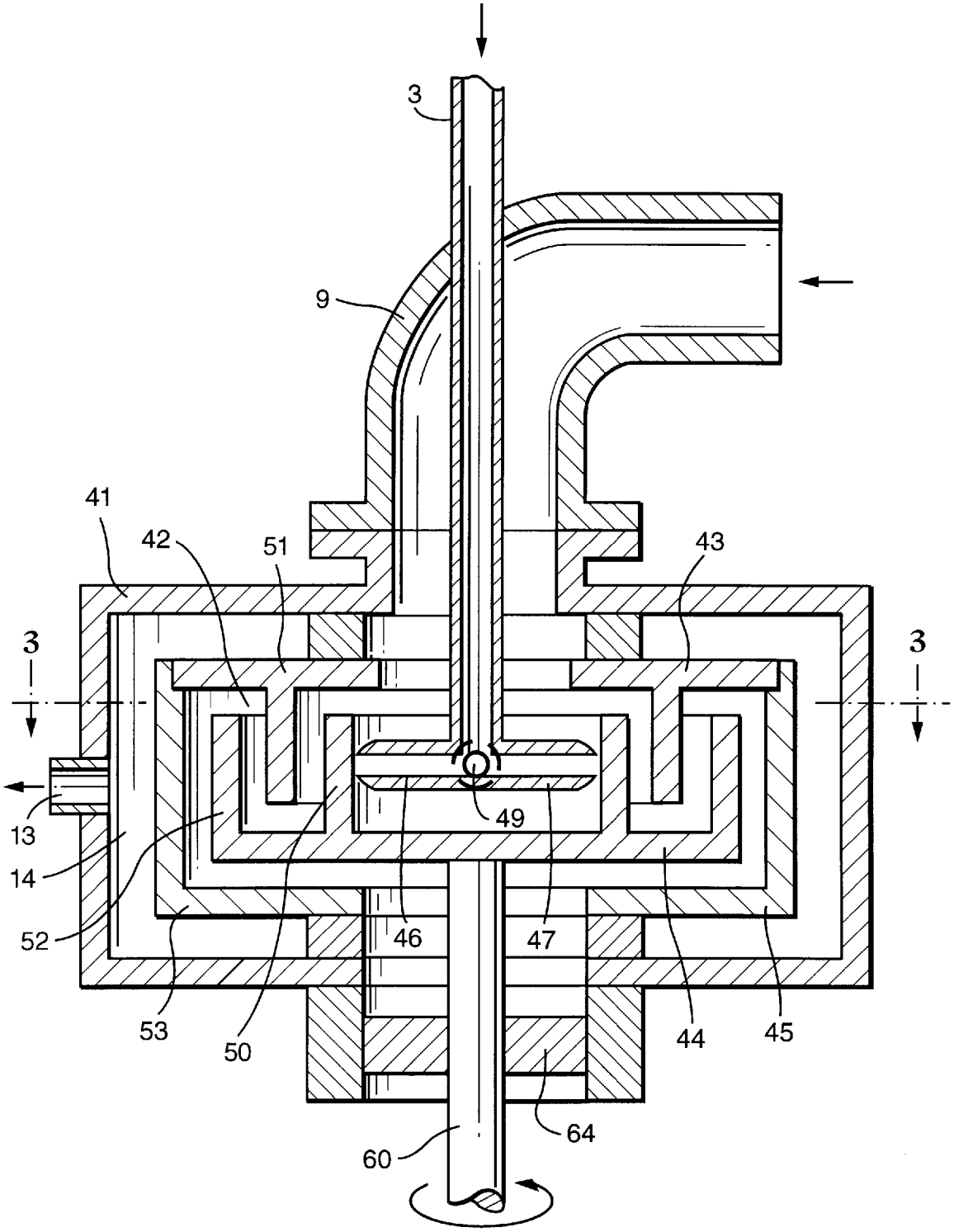
Figure 3:
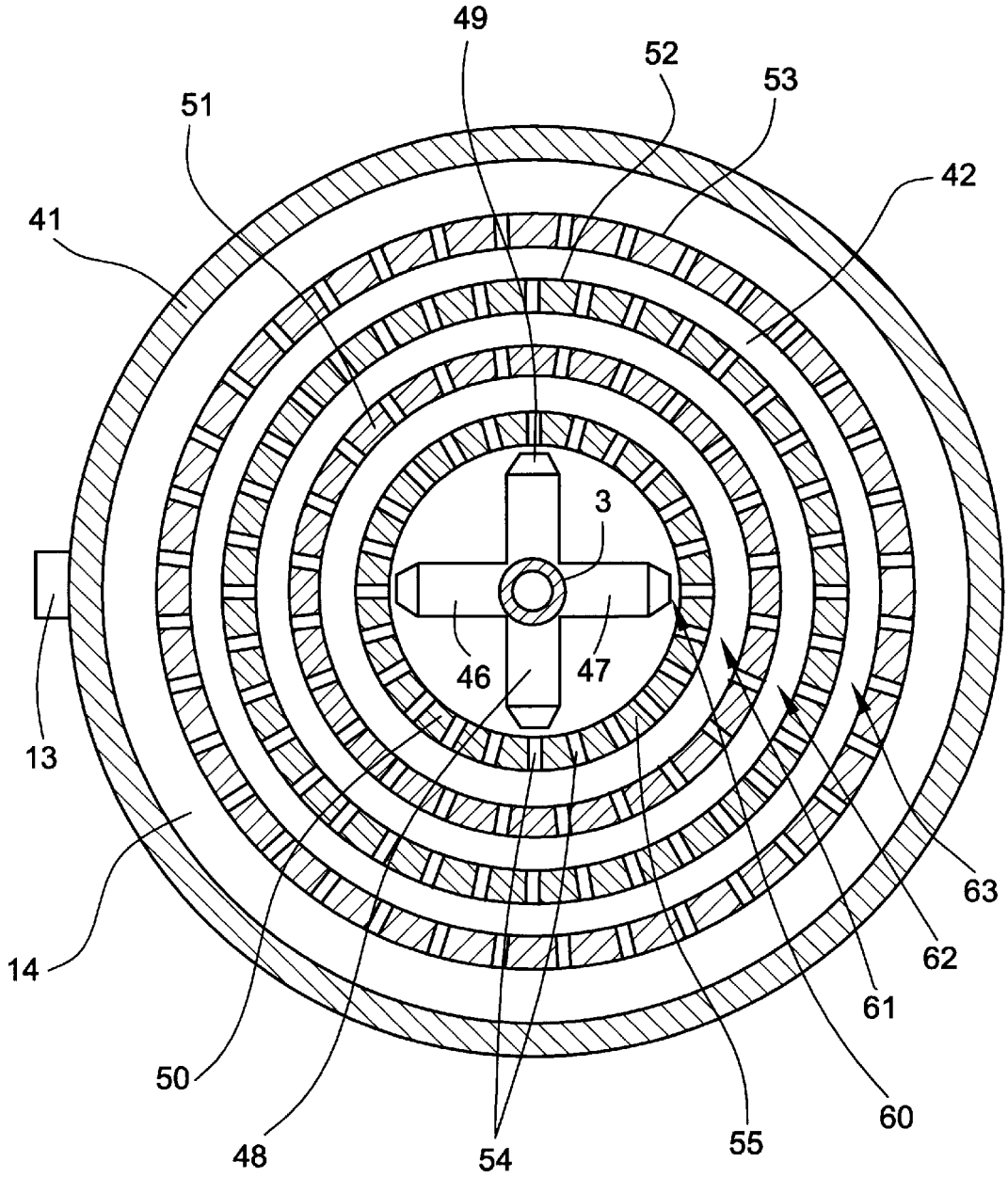
Figure 4:
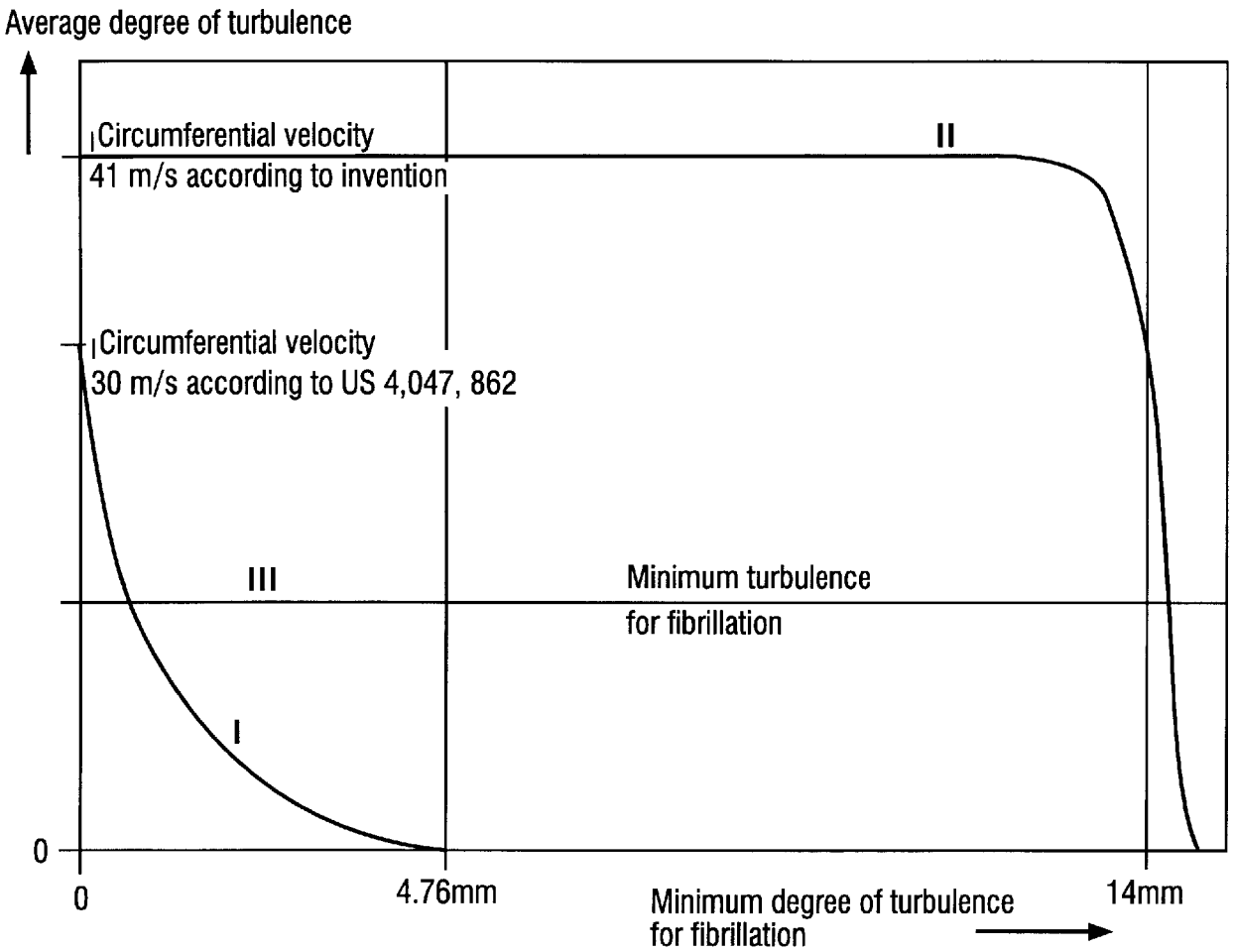
Figure 5:
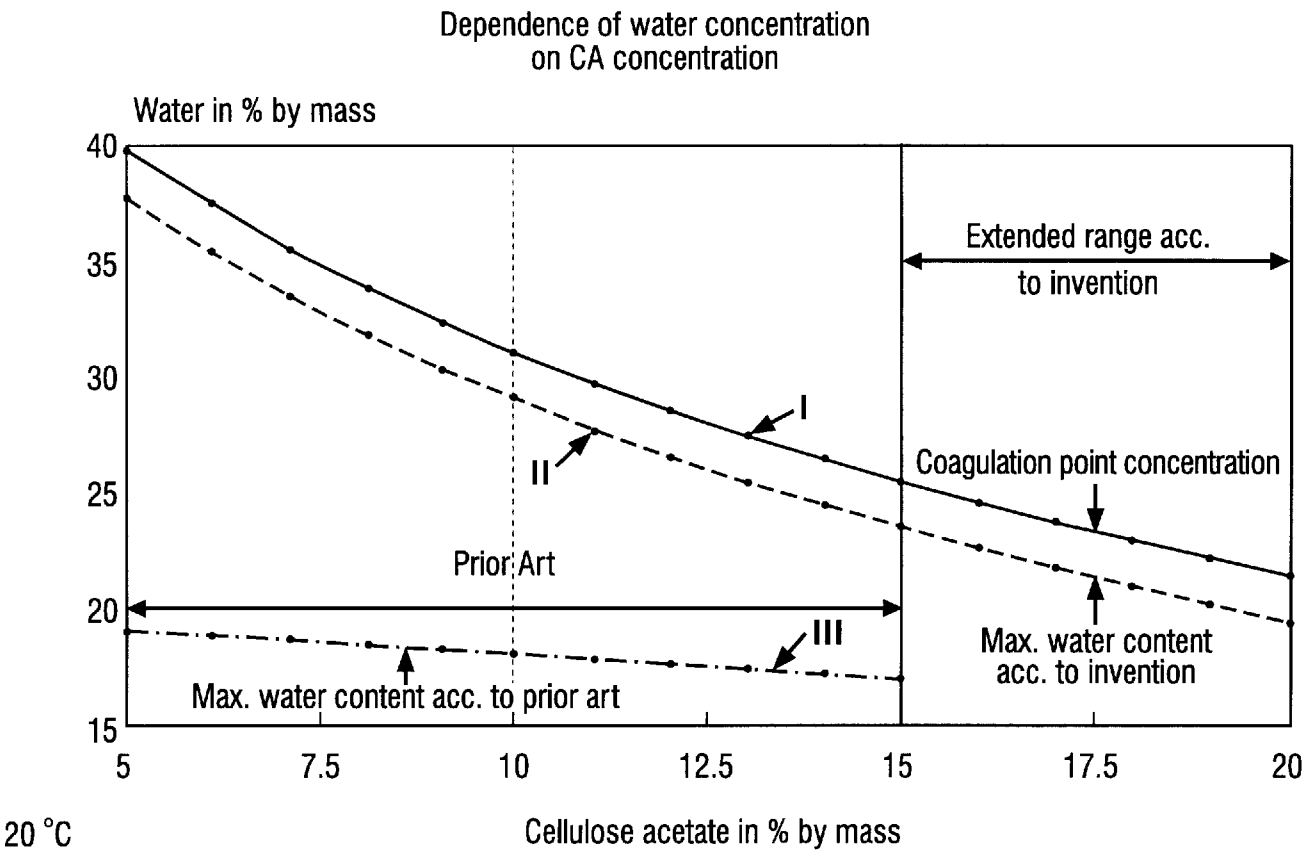

Exemplary embodiments will now be illustrated with reference to the drawings, in which FIG. 1 shows a schematic representation of the entire fibret production system, FIG. 2 shows a vertical section through a dispersing facility, FIG. 3 shows a section along the line III—III through the dispersing facility shown in FIG. 2, FIG. 4 shows a graphic representation of the degree of turbulence as a function of the distance from the nozzle, and FIG. 5 shows a graphic representation of the water concentration as a function of the CA concentration.

FIG. 1 illustrates the fibret production system. The raw material, for example cellulose acetate, is fed via feed line 1 into a dope makeup tank 2, which, via line 31, is fed with solvent from the recovery system 26. A dope line 3 feeds the dope into a dispersing facility 40, where the coagulation is carried out. The coagulant is made up in a coagulation bath makeup tank 8, into which, via line 27, nonsolvent, preferably water, is fed from the recovery system 26. A coagulation bath supply line 9 directs the made-up coagulant into the dispersing facility 40, where the coagulant is brought together with the dope. This will be described in connection with FIG. 2.

The coagulation bath suspension is fed together with the fibrets which have been produced into the distillation system 12 via the coagulant bath discharge line 13. A steam supply line 15 feeds steam into the distillation system 12, and the solvent return line 17 feeds the removed solvent initially via a heat exchanger 16 into the recovery system 26, where the solvent is recovered so that it may thereafter be re-used in the dope makeup tank 2 or the coagulation bath makeup tank 8.

After the solvent has been separated off, the fibrets are fed via take-off line 19 into a high pressure homogenizer 20. From there the fibrets pass into a stack tank 22 and on into a drum filter 24, where the fibrets are concentrated to the desired final concentration, the coagulation bath likewise being fed into the recovery system 26 via return line 25. The fibrets thus recovered are fed via the fibret discharge line 23 to a further processing unit. From the recovery system 26, the recovered solvent, which may comprise a certain proportion of nonsolvent, and the nonsolvent, which may in turn comprise a proportion of solvent, are introduced via lines 27 and 31, respectively, into tanks 2 and 8.

FIG. 2 illustrates the dispersing facility 40 in vertical section. The curved feed line 9 feeds the coagulant into the interior of the dispersing facility 40. The dope supply line 3 is situated within the supply line 9 and is enclosed by the latter, so that both the dope and the coagulant can be directed centrally into the dispersing facility 40. Within the housing 41, the dope line 3 branches into the nozzles 46 and 47, which, together with nozzles 48 and 49, which are depicted in FIG. 3, are disposed in a star shape. The nozzles extend radially outward and terminate just short of the innermost sprocket 50, which is part of the rotor 44. This rotor 44 is driven by a driveshaft 65, which extends downwardly from the housing 41 and is driven by a motor (not depicted). The housing 41 is sealed off via a sliding ring seal 64. The rotor 44, which has a base plate 10, comprises not only the first sprocket 50 but, spaced apart therefrom, a further sprocket (third sprocket) 52. Between the two sprockets 50 and 52 there is situated a second sprocket 51, which belongs to stator 43. Stator 43, which has a ring-shaped base plate 11, is disposed above nozzles 46–49, so that the second sprocket 51 extends downwardly and is secured to the housing 41. Underneath the rotor there is disposed a further stator 45, which comprises the outer or fourth sprocket 53.

Since the coagulation bath supply line 9 is sealed off with respect to stator 43, the coagulant is supplied centrally and flows around the nozzles 46 to 49. The dope, which is supplied through dope line 3, exits from nozzles 46 to 49 in a radial direction and enters the shearing field which extends through the sprockets 50–53 into the outer region 14. Dope and coagulant are initially seized and accelerated by the sprocket 50. Owing to the radial direction of flow of dope and coagulant, which is superposed on the transverse flow, the dope and the nascent fibrets leave zone 60 through the gaps 54 between the teeth 55 of the first sprocket 50 in the radial direction, dope and coagulant being decelerated. The liquid then passes into a further zone 61 between sprocket 50 and sprocket 51, where the liquid is accelerated again. This sprocket 51 is stationary, being part of the stator. From there the fibrets pass in succession into the further zones 62 and 63 between sprockets 51 and 52 on the one hand and 52 and 53 on the other, where accelerations and decelerations again alternate. After the fourth sprocket 53 has been left behind as well, the fibrets are discharged, together with the coagulation bath, in the form of a suspension through the discharge pipe 13. This apparatus was used to produce fibrets which are described in the examples which follow.

FIG. 4 is a schematic representation of the course of the average degree of turbulence of the dope/coagulant mixture as a function of the distance from the nozzle as per the prior art (U.S. Pat. No. 4,047,862—curve I) and according to the invention (curve II). For fibrets to be produced, a minimum degree of turbulence has to be exceeded, and that minimum degree of turbulence required is characterized by the straight line III. Underneath the curve III, the turbulence is too low for coagulation, so that the desired fineness is never obtained for the fibrets.

Curve I describes the degree of turbulence between the rotating nozzles and the stationary wall, which are merely 0.1875 inches (=4.7625 mm) apart, although ultimately less than this distance is available for fibret production. The degree of turbulence required for fibret production is achieved only just downstream of the nozzles, and it then drops off exponentially, so that only a relatively short distance is available for fibret production.

In contrast, the shearing field which the present invention achieves in a dispersing facility as per FIGS. 2 and 3 extends over about 14 mm (distance from sprocket 50 to sprocket 53), and the minimum degree of turbulence required for fibret production is exceeded on exit from the nozzle and remains constant. Curve II does not fall off steeply until the outer region (see FIG. 2) 14 is reached. Whereas, in U.S. Pat. No. 4,047,862, circumferential speeds of about 30 m/sec are used, the speed of rotation of the rotor of the dispersing facility is 41 m/sec in this example.

EXAMPLE 1

480 g of a cellulose acetate (CA) from Eastman Chemical Company (type CA 398-3) are dissolved in 3840 g of acetone and 480 g of water. The resulting dope thus comprises 10% by mass of CA, 10% by mass of water and 80% by mass of acetone. The ratio of acetone to water is 8. The dope is passed at ambient temperature at a mass flow rate of 3 kg/min through a four-jet nozzle, which has a diameter of 5 mm in each case and whose ends are situated 0.10 mm away from the inner rotor, into the coagulation bath. The coagulation medium used is water, again at ambient temperature, which passes into the coagulation space at a mass flow rate of 34.5 kg/min. The mass flows of coagulation bath and dope are in a ratio of 11.5:1. The dispersing machine is equipped with four sprockets of the "fine" (see Table 1) specification. The coagulation takes place at a speed of 12,000 $min^{-1}$. After coagulation, the CA fibrets are present in a concentration of 0.8% by mass. Acetone is present at 6.5% by mass. The values mentioned and the values for the runs which follow are compared in Table 2. The acetone is removed by an open distillation at ambient pressure. After the removal of acetone, the fibrets are homogenized in a single stage at a pressure of 150 bar using a high pressure homogenizer from APV GAULIN, type LAB 60. The fibrets are concentrated with a suction filter for collection. The result is a filter cake having a solids concentration of 8.6% by mass.

This variant is within the domain of the prior art as regards the concentrations; only the coagulation was carried out with the dispersing machine according to the invention, and a post-coagulation filtration was dispensed with.

EXAMPLE 2

Run 1 was repeated with the coagulation bath mass flow rate reduced to 22 kg/min, affording a ratio of the mass flows of coagulation bath to dope of 7.3 and an ascoagulated fibrets concentration of 1.2% by mass (coupled with 9.6% by mass of acetone). The high pressure homogenization was omitted.

TABLE 1

Data re rotor/stator geometry

| Size | | 1st sprocket Inner rotor | 2d sprocket Inner stator | 3d sprocket Outer rotor | 4th sprocket Outer stator |
|---|---|---|---|---|---|
| Outer diameter | mm | 52.3 | 58.1 | 65.2 | 74.0 |
| Inner diameter | mm | 46.3 | 53.1 | 58.8 | 66.0 |
| i.e. | | | | | |
| sprocket thickness | mm | 3.0 | 2.5 | 3.2 | 4.0 |
| sprocket spacing | mm | 0.40 | 0.35 | 0.40 | |
| Fine version: | | | | | |
| Number of teeth | — | 36 | 42 | 36 | 69 |
| Gap size | mm | 2.0 | 1.5 | 2.0 | 1.0 |
| Tooth size | | | | | |
| outside | mm | 2.56 | 2.85 | 3.69 | 2.37 |
| inside | mm | 2.04 | 2.47 | 3.13 | 2.01 |
| Gap volume | % | 46.5 | 36.1 | 37.0 | 31.4 |
| Coarse version: | | | | | |
| Number of teeth | — | 20 | 18 | 20 | 36 |
| Gap size | mm | 4.0 | 4.0 | 4.0 | 2.0 |
| Tooth size | | | | | |
| outside | mm | 4.22 | 6.14 | 6.24 | 4.46 |
| inside | mm | 3.27 | 5.27 | 5.24 | 3.76 |
| Gap volume | % | 51.7 | 41.2 | 41.1 | 32.7 |

TABLE 2

Data for illustrative embodiments

| Parameter | Example 1 | 2 | 3 | 4 | 5 | 6 | 7 | 8 | 9 | 10 |
|---|---|---|---|---|---|---|---|---|---|---|
| Dope composition in g | | | | | | | | | | |
| CA | 480 | 480 | 480 | 480 | 480 | 480 | 480 | 480 | 480 | 480 |
| acetone | 3840 | 3840 | 3840 | 3840 | 2400 | 1680 | 2400 | 2400 | 2400 | 1680 |
| water | 480 | 480 | 480 | 480 | 550 | 510 | 550 | 550 | 500 | 840 |
| Dope composition in % | | | | | | | | | | |
| CA | 10 | 10 | 10 | 10 | 14 | 18 | 14 | 14 | 14 | 16 |
| acetone | 80 | 80 | 80 | 80 | 70 | 73 | 70 | 70 | 70 | 56 |
| water | 10 | 10 | 10 | 10 | 16 | 19 | 16 | 16 | 16 | 28 |
| Ratio of acetone:CA | 8 | 8 | 8 | 8 | 5 | 3.5 | 5 | 5 | 5 | 3.5 |
| Coagulation bath composition in % | | | | | | | | | | |
| water | 100 | 100 | 100 | 100 | 100 | 100 | 95 | 90 | 85 | 95 |
| acetone | 0 | 0 | 0 | 0 | 0 | 0 | 5 | 10 | 15 | 5 |
| Mass flows in kg/min | | | | | | | | | | |
| dope | 3.0 | 3.0 | 3.00 | 3.0 | 3.0 | 3.0 | 3.0 | 3.0 | 3.0 | 3.0 |
| coagulation bath | 34.5 | 22.0 | 15.75 | 12.0 | 21.7 | 29.7 | 21.9 | 21.6 | 21.7 | 29.1 |
| Mass flow ratio of coagulation bath to dope | 11.5 | 7.3 | 5.25 | 4.0 | 7.2 | 9.9 | 7.3 | 7.2 | 7.2 | 9.7 |

TABLE 2-continued

| Data for illustrative embodiments | | | | | | | | | | |
|---|---|---|---|---|---|---|---|---|---|---|
| | Example | | | | | | | | | |
| Parameter | 1 | 2 | 3 | 4 | 5 | 6 | 7 | 8 | 9 | 10 |
| Suspension composition in % | | | | | | | | | | |
| CA | 0.8 | 1.2 | 1.6 | 2.0 | 1.7 | 1.65 | 1.7 | 1.7 | 1.7 | 1.5 |
| acetone | 6.4 | 9.6 | 12.8 | 16.0 | 8.5 | 5.80 | 12.8 | 17.3 | 21.7 | 9.8 |
| water | 92.8 | 89.2 | 85.6 | 82.0 | 89.8 | 92.55 | 85.5 | 81.0 | 76.6 | 88.7 |

EXAMPLE 3

Run 1 was repeated with the coagulation bath mass flow rate reduced to 15.75 kg/min, affording a ratio of the mass flows of coagulation bath to dope of 5.25 and an as-coagulated fibrets concentration of 1.6% by mass (coupled with 12.8% by mass of acetone). The high pressure homogenization was omitted.

EXAMPLE 4

Run 1 was repeated with the coagulation bath mass flow rate reduced to 12 kg/min, affording a ratio of the mass flows of coagulation bath to dope of 4.0 and an ascoagulated fibrets concentration of 2.0% by mass (coupled with 16.0% by mass of acetone). The high pressure homogenization was omitted.

EXAMPLE 5

Run 1 was repeated with the mass ratio of acetone to CA adjusted to 5, affording a mass flow ratio of coagulation bath to dope of 7.2 and an as-coagulated fibrets concentration of 1.7% by mass coupled with 8.5% by mass of acetone.

EXAMPLE 6

Run 1 was repeated with the mass ratio of acetone to CA adjusted to 3.5, affording a mass flow ratio of coagulation bath to dope of 9.9 and an as-coagulated fibrets concentration of 1.65% by mass coupled with 5.80% by mass of acetone.

EXAMPLE 7

Run 5 was repeated with a coagulation bath comprising 5% by mass of acetone, affording a post-coagulation acetone content of 12.8% by mass as a result. The high pressure homogenization was omitted.

EXAMPLE 8

Run 5 was repeated with a coagulation bath comprising 10% by mass of acetone, affording a post-coagulation acetone content of 17.3% by mass as a result. The high pressure homogenization was omitted.

EXAMPLE 9

Run 5 was repeated with a coagulation bath comprising 15% by mass of acetone, affording a post-coagulation acetone content of 21.7% by mass as a result. The high pressure homogenization was omitted.

EXAMPLE 10

Run 6 was repeated, except that water was additionally added to the dope up to a level of 28% by mass. The coagulation bath had an acetone content of 5% by mass. The post-coagulation concentration of the fibrets was 1.5% by mass coupled with an acetone concentration of 9.8% by mass.

EXAMPLE 11

Run 5 was repeated using "coarse" sprocket geometries instead of the "fine" sprocket geometries.

EXAMPLE 12

Run 5 was repeated, except that the "fine" sprocket geometries were replaced by "coarse" for the rotor sprockets and "fine" for the stator sprockets.

Each of the samples had specific surface areas of above 20 $m^2/g$ and individual fiber dimensions preferably below 1 $\mu$m. However, more far-reaching parameters, such as homogeneity, accessibility of fiber networks to flow, etc., are critical for filtration.

The quality of the fibrets produced was therefore assessed by their performance in a filter layer. The filter layer employed for this purpose had the following composition:

25% by mass of CA fibrets,

35% by mass of microcrystalline cellulose having a particle size distribution modal value at 28 $\mu$m, 30% by mass of unground long fiber pulp, and 10% by mass of long fiber pulp ground to 80° SR.

An epichlorohydrin resin was added in an amount of 0.4% by mass, based on the total solids, to adjust the wet strength. The layers had a basis weight of 1350 $g/m^2$.

The layers were tested with a suspension of 0.5% by mass of ground raw cane sugar in water. The test area was 100 $cm^2$. The throughput was measured after 30 min under a pressure difference of 1 bar. A sample was taken after a filtration time of 15 min for a turbidity measurement to determine the separation effect. The original turbidity was about 2.40 TU/area for all the layers in the parallel test series. Each of the filter layers prepared with the fibrets described was tested in three runs. Table 3 reports the averages.

TABLE 3

| Results of filtration tests | | |
|---|---|---|
| Layer with fibrets Example No.: | Throughput in 30 min liter | Turbidity of sample TU/area |
| 1 | 12.1 | 0.24 |
| 2 | 13.5 | 0.28 |
| 3 | 13.8 | 0.29 |

TABLE 3-continued

| Results of filtration tests | | |
|---|---|---|
| Layer with fibrets Example No.: | Throughput in 30 min liter | Turbidity of sample TU/area |
| 4 | 14.2 | 0.32 |
| 5 | 14.4 | 0.30 |
| 6 | 15.2 | 0.36 |
| 7 | 14.1 | 0.29 |
| 8 | 13.7 | 0.26 |
| 9 | 13.3 | 0.24 |
| 10 | 15.7 | 0.39 |
| 11 | 14.1 | 0.33 |
| 12 | 14.3 | 0.29 |

Differences are discernible between the layers. However, these differences are not so marked that the fibrets of any one of the illustrative embodiments would have to be rejected as regards use in filter layers. In most cases, a somewhat higher turbidity correlates with a correspondingly higher throughput. This must not be rated negatively, since filtration performance is assessed on the basis of a relation constructed from throughput and separating effect. In addition, it is possible to modify the filtration behavior by modifying the filter layer recipe.

The fibrets of sample 9 deserve a favorable mention. Here the addition of acetone to the coagulation medium manifests itself in better fibrillation. By contrast, the geometry used for the sprockets does not have any significant effect on fibret quality in the range under investigation.

FIG. 5 is a plot of the maximum possible water content against the concentration of the cellulose acetate in the dope (both in % by mass) at a temperature of 20° C. The acetone content is obtained on subtracting the respective CA and water concentrations from 100% by mass.

As well as the concentration at the coagulation point (curve I), the plot also shows the maximum possible concentrations of water as per the invention (curve II) and as per the prior art (U.S. Pat. No. 5,071,599 and U.S. Pat. No. 5,175,376)—curve III. According to the prior art, between 5 and 15% by mass of cellulose acetate can be dissolved in the dope. The cellulose acetate is dissolved in a solution which can have a maximum water content of 20% by mass. The data for the water thus always relate to the binary system of acetone+water, whereas the data according to the invention always apply to the ternary system of acetone+water+Ca. In the case of a cellulose acetate content of 5% by mass, the maximum water content according to the prior art can thus only be 20% of 95%, i.e. 19% by mass of water.

It is clear from the diagram that the biggest difference compared with the prior art exists at 5% by mass of cellulose acetate and the smallest at 15% by mass of cellulose acetate.

5% by mass of cellulose acetate:

Coagulation point concentration
- 5.0% by mass of cellulose acetate
- 39.7% by mass of water
- 55.3% by mass of acetone Maximum water content according to invention
- 5.0% by mass of cellulose acetate
- 37.7% by mass of water
- 57.3% by mass of acetone Maximum water content according to prior art
- 5.0% by mass of cellulose acetate
- 19.0% by mass of water
- 76.0% by mass of acetone Difference in water content compared with prior art
- 18.7% by mass (based on dope)

15% by mass of cellulose acetate:

Coagulation point concentration
- 15.0% by mass of cellulose acetate
- 25.5% by mass of water
- 59.5% by mass of acetone Maximum water content according to invention
- 15.0% by mass of cellulose acetate
- 23.5% by mass of water
- 61.5% by mass of acetone Maximum water content according to prior art
- 15.0% by mass of cellulose acetate
- 17.0% by mass of water
- 68.0% by mass of acetone Difference in water content compared with prior art
- 6.5% by mass (based on dope)

FIG. 5 is a clear illustration of the advantages of the invention, which are that the cellulose acetate content can be made significantly larger (see extended range according to invention) and that the water content can be distinctly higher, as a result of which, as described above, decisive advantages are achieved in processing procedure (omission of the filtration stage) and processing costs (recovery with less effort).

What is claimed is:

1. A process for producing fibrets which comprises directing a dope comprising a cellulose derivative and a suitable solvent therefor into a coagulant, alternately accelerating and decelerating the suspension of dope and coagulant a least twice in the shearing field to coagulate the dope and form fibrets, and then separating off the fibrets, the solvent and the coagulant, and wherein coagulation is performed in a dispersing facility comprised of a rotor and a stator.

2. The process of claim 1, wherein the cellulose derivative is at least one selected from the group consisting of cellulose esters and cellulose ethers.

3. The process of claim 1, wherein the suspension is alternately subjected to a radial and a transverse flow.

4. The process according to claim 1, wherein the dope is directed into the coagulant through stationary nozzles which exit onto flow-generating means moving past.

5. The process of claims 1, wherein the dope is made up using cellulose acetate, cellulose triacetate, cellulose acetate butyrate, cellulose acetate propionate, benzylcellulose or ethylcellulose or mixtures thereof.

6. The process of claim 5, wherein the cellulose acetate has an acetyl value between 54 and 56%.

7. The process of any one of claim 1, wherein the proportion of cellulose derivative in the dope is 3–20%.

8. The process of any one of claim 1, wherein the ratio of solvent to cellulose derivative in the dope is adjusted to 2.8–4.4.

9. The process of any one of claim 1, wherein the solvent used is acetone, acetic acid, methyl acetate, methyl ethyl ketone, 1,4-dioxane, acetaldehyde, ethyl acetate, tetrahydrofuran or methyl isopropyl ketone or a mixture thereof.

10. The process of any one of claim 1, wherein the dope further comprises a nonsolvent.

11. The process of claim 10, wherein the nonsolvent used is water, ethanol or methanol.

12. The process of claim 10 or 11, wherein the nonsolvent content is at least 2% below the nonsolvent content (coagulation point content) sufficient to initiate coagulation in the cellulose derivative/solvent mixture used.

13. The process of claim 12, wherein the nonsolvent content is 2–20% below the coagulation point content.

14. The process of claim 1, wherein the nonsolvent content of the dope is up to 40%.

15. The process of claim 1, wherein basic flow velocities of up to 100 m/sec are generated in the coagulation bath.

16. The process of claim 1, wherein the coagulant volume flow is adjusted so that the fibret content of the coagulation bath is between 1 and 2.5% by mass.

17. The process of claim 1, wherein the volume flows of coagulation bath and dope are adjusted to a ratio between 10:1 and 2.5:1.

18. The process of claim 1, wherein the post-coagulation bath comprises up to 25% by mass of solvent.

19. The process of claim 1, wherein the solvent content of the post-coagulation bath is 15–25% by mass.

20. The process of claim 1, further comprising homogenizing the fibrets without prior filtration after solvent removal.

21. Apparatus for producing fibrets from cellulose derivatives, comprising a facility for making up a dope of cellulose derivatives and solvent, at least one nozzle for directing the dope into a coagulant and a facility for removing the fibrets from solvent and coagulant, wherein the at least one nozzle is disposed within a dispersing facility comprising rotor and stator and further comprising at least two sprockets of which at least one sprocket is part of the rotor of the dispersing facility, and the dispersing facility comprises a feed line for the coagulant.

22. The apparatus of claim 21, wherein the nozzle is disposed in the interior of the dispersing facility and is oriented to point radially outward onto the first sprocket.

23. The apparatus of claim 21 or 22, wherein the first sprocket is part of the rotor of the dispersing facility.

24. The apparatus of claim 21, wherein the nozzle-sprocket distance is 0.01–5 mm.

25. The apparatus of claim 24, wherein the nozzle sprocket distance is 0.01–1 mm.

26. The apparatus of claim 21, wherein the nozzle diameter is 5–10 mm.

27. The apparatus of claim 21, wherein at least two nozzles are disposed symmetrically within the first sprocket.

28. The apparatus of claim 21, wherein the coagulant supply line encloses the dope line.

29. The apparatus of claim 21, wherein the at least one nozzle is disposed outside the sprockets of the dispersing facility and is oriented to point radially inward onto the outermost sprocket.

* * * * *